United States Patent [19]

Galle, Jr. et al.

[11] Patent Number: 4,691,780

[45] Date of Patent: Sep. 8, 1987

[54] SUBSEA WELLHEAD STRUCTURE

[75] Inventors: Edward M. Galle, Jr.; Kevin Gendron; Paul C. Berner, Jr., all of Houston, Tex.

[73] Assignee: Cameron Iron Works, Inc., Houston, Tex.

[21] Appl. No.: 740,523

[22] Filed: Jun. 3, 1985

[51] Int. Cl.[4] ..... E21B 43/01

[52] U.S. Cl. ..... 166/348; 166/208; 166/368; 285/141

[58] Field of Search ..... 166/341, 348, 368, 208, 166/123, 125; 285/140, 141, 142

[56] References Cited

U.S. PATENT DOCUMENTS

| | | | |
|---|---|---|---|
| 3,543,847 | 12/1970 | Haeber | 166/348 |
| 3,827,488 | 8/1974 | Piazza et al. | 255/142 |
| 3,913,670 | 10/1975 | Ahlstone | 285/142 |
| 3,920,071 | 11/1975 | Cegielski | 166/208 |
| 4,422,507 | 12/1983 | Reimert | 166/348 |
| 4,471,965 | 9/1984 | Jennings et al. | 277/26 |
| 4,474,236 | 10/1984 | Kellett | 166/348 |
| 4,550,782 | 11/1985 | Lawson | 285/141 |

*Primary Examiner*—Stephen J. Novosad
*Assistant Examiner*—William P. Neuder
*Attorney, Agent, or Firm*—Vinson & Elkins

[57] ABSTRACT

A subsea wellhead structure including a casing hanger having an exterior downwardly facing shoulder for landing within a well bore, a central bore, means for connecting a casing thereto, an upper exterior surface tapering downwardly and outwardly, and an external surface below said shoulder tapering downwardly and inwardly for centering said hanger on landing, a seal assembly with a metal seal sleeve having downwardly extending fingers, an internal metal annular bulbous sealing surface and an external metal cylindrical sealing surface, means for latching said seal sleeve in sealing position, a protector sleeve and means for releasably securing said protector sleeve to said seal assembly and said latching means, the latching means including retaining means preventing premature setting or movement of the latching means prior to the setting of said sealing means.

17 Claims, 7 Drawing Figures

SUBSEA WELLHEAD STRUCTURE

BACKGROUND

The present invention involves an improved subsea wellhead structure in which the casing hanger, the seal around the casing hanger and the bore protector are run into the wellhead housing on a single running string.

In prior subsea wellhead structures, casing hangers have been run on a string and have included a split ring to latch the hanger in position when it is landed, a passage around the hanger through which fluid may flow during cementing and a seal which is movable into position to seal the passage after the completion of the cementing. The seal includes a resilient member between rings and is set by rotation of the setting sleeve with a setting tool. This structure is illustrated in U.S. Pat. No. 3,273,646.

U.S. Pat. No. 3,350,130 discloses a similar structure in which there is also a seat protector included in the structure run into the well bore with the casing hanger which is releasably connected to the actuating sleeve for setting the hanger seal.

Another similar structure is shown in U.S. Pat. No. 3,489,436 in which the mandrel is releasably connected by locking segments which are released by a pressure responsive device which is activated by a plug seated within the mandrel.

The hanger seal shown in U.S. Pat. No. 3,797,864 includes a resilient seal backed up at each end by metal end caps with inner and outer legs which engage the surfaces in metal-to-metal sealing engagement and present extrusion of the resilient seal ring.

These prior art structures all rely upon a resilient sealing ring for the sealing between the exterior of the hanger and the interior of the wellhead housing. They also have complicated structures for release of the running tool and for recovery of the protection sleeve. Another disadvantage of the devices of the prior art is that they require a washing step following the cementing step to clean the sealing surfaces.

SUMMARY

The present invention related to an improved subsea wellhead structure having a housing suspended in the well bore with an internal shoulder, and an internal groove below the shoulder, a casing hanger having a downwardly facing shoulder and pins suitable for engaging within said groove, and a surface tapering inwardly and upwardly to provide an annular space which is reduced in sectional area in the downward direction, means for connecting a running tool to the casing hanger, a seal assembly including a ring having a plurality of slots on its lower end, an internal bulbous section above the slots and latching means, a bore protector, means for connecting the latching means to the bore protector and means for connecting the combined seal assembly and bore protector to the running tool so that the seal assembly can be set and latched and the running tool released both from the casing hanger and from the seal assembly and bore protector structure.

An object of the present invention is to provide an improved subsea wellhead structure which can be run on one tool in one trip, provide positive indication of the proper landing of the casing hanger, and have a positive metal-to-metal seal.

Another object is to provide an improved subsea wellhead structure which provides an positive metal-to-metal seal without surface washing of the sealing surfaces following cementing.

A further object is to provide an improved subsea wellhead structure in which the movement for setting and latching of the seal also provides a release of the connection of the running tool from the structure.

A still further object of the present invention is to provide an improved subsea wellhead structure in which the seal latching structure provides the load transmission structure for the next casing hanger installed in the structure.

A still further object is to provide an improved subsea wellhead structure which can be set and released by right hand rotation of the running and retrieving tools.

Another object is to provide an improved subsea wellhead structure with a means for latching the seal assembly in set position which avoids possible inadvertent movement of the latching means until positively set.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENT

The improved wellhead structure of the present invention is contained within subsea wellhead housing 10 which is positioned within landing base 12 on the bottom 14 of a body of water with blowout preventer stack 16 positioned thereon. This well is in process of being drilled and normally during drilling the well bore casings are set progressively within the bore and cemented in place to secure the well bore which has been drilled.

Figure 1:
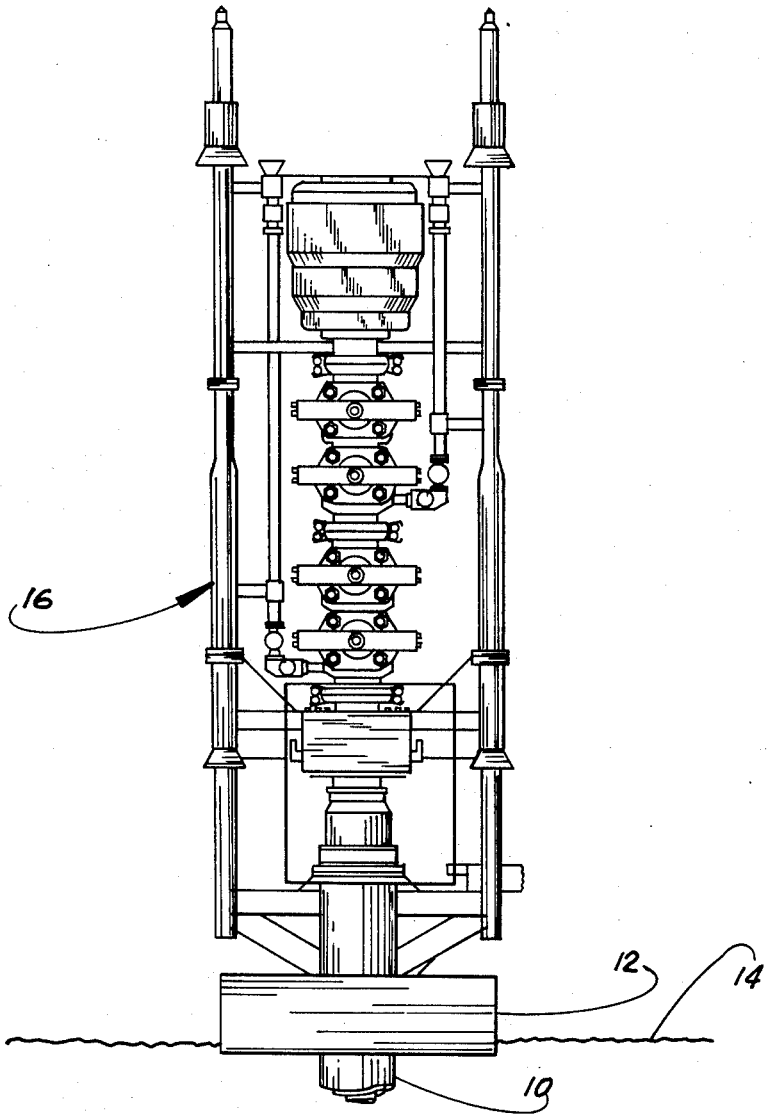
FIG. 1 is an elevation view of the location of the improved subsea wellhead structure of the present invention.
Figure 2:
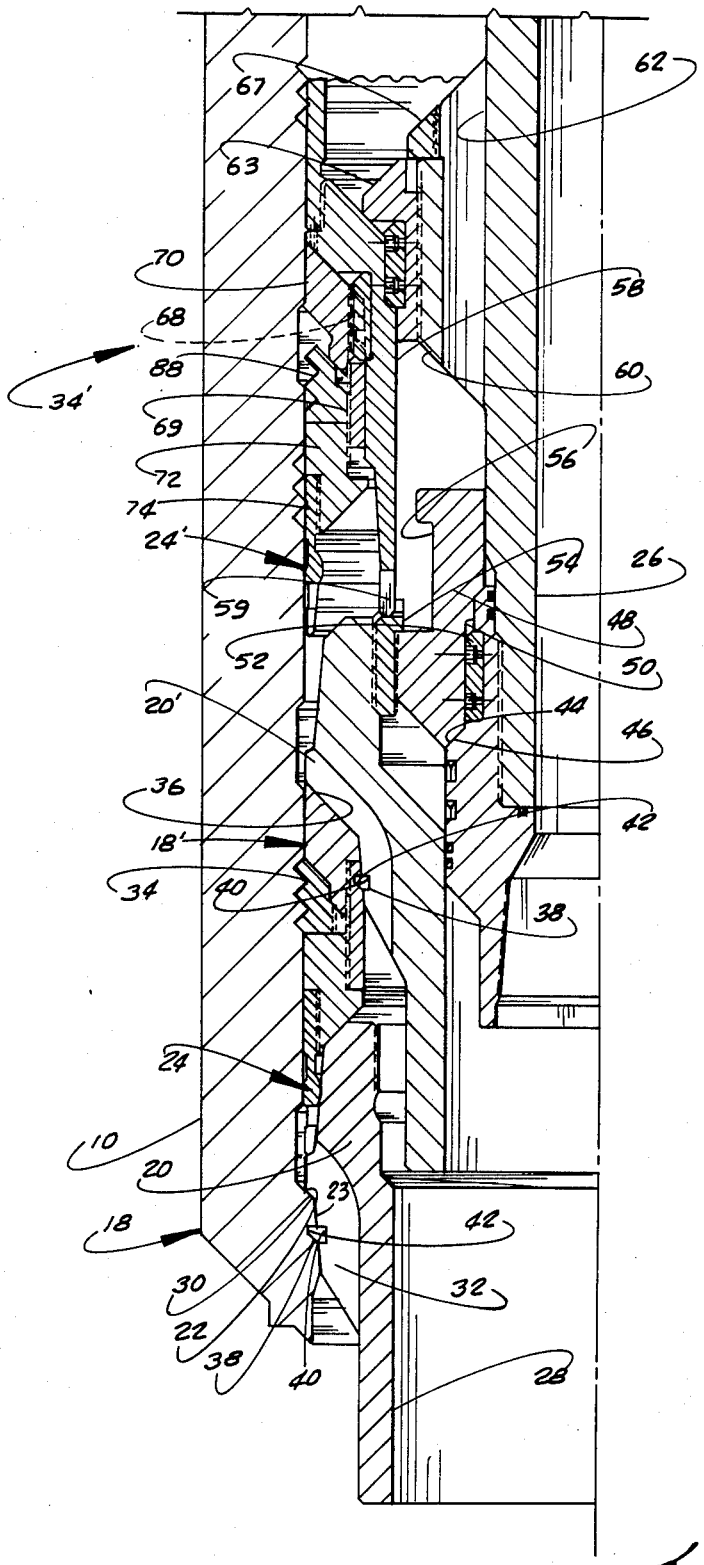
FIG. 2 is a partial sectional view of the improved structure of the present invention as the second casing hanger is landed in the well bore. s is landed in t FIG. 3. is another partial sectional view of the improved structure of the present invention with the second casing hanger seated, the seal set and latched with the protector sleeve above and the running tool removed.
Figure 3:
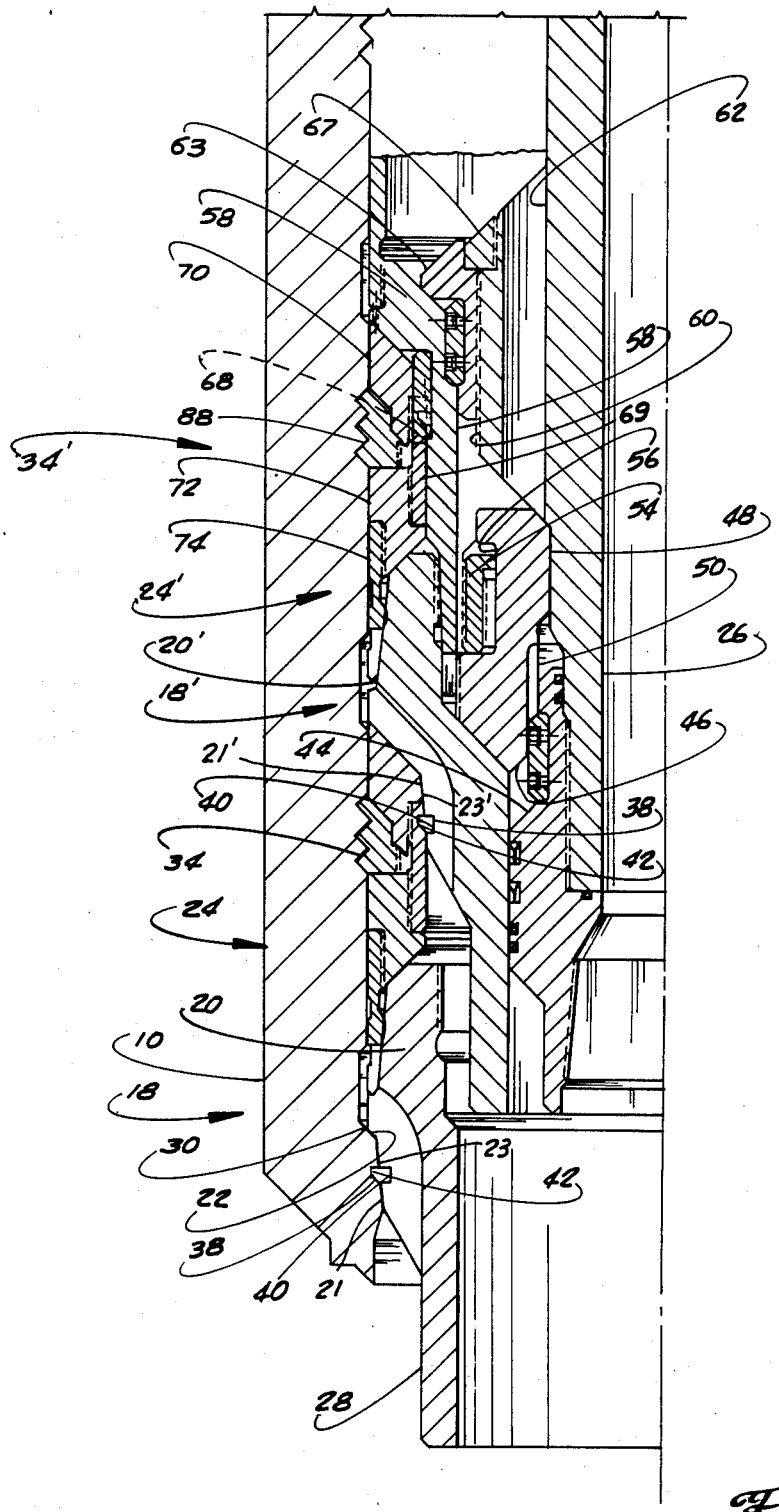

Wellhead structure 18, shown in FIG. 2, has been landed within wellhead housing 10 with large diameter casing hanger 20 landed on internal shoulder 22 within housing 10, with seal assembly 24 set and latched, the well bore protector removed and the next wellhead structure 18' supported on running tool 26 with casing hanger 20' landed and latched as shown and seal assembly 24' unset. External surface 21 of hanger 20 tapers downwardly and inwardly to engage and mate with surface 23 of housing 10 and thereby ensure the centering of hanger 20 within housing 10 together with all of the components run with hanger 20. Casing hanger 20 includes tubular body 28 having external downwardly facing shoulder 30 which seats on housing shoulder 22, external slots 32 with suitable means for connecting to a suitable running tool at its upper end and means (not shown, normally threads) for supporting casing from its lower end. Seal assembly 24 is in set position providing a metal-to-metal seal between the interior of housing 10 and the exterior of casing hanger 20. Seal latch assembly 34 is set and provides upwardly facing internal shoulder 36 for receiving casing hanger 20'. Casing hanger 20' includes external surface 21' which tapers downwardly and inwardly to engage and mate with surface 23' on the interior of latching assembly 34 which is also tapered similarly to ensure centering of casing hanger 20' within housing 10 and wellhead structure 18.

Figure 4:
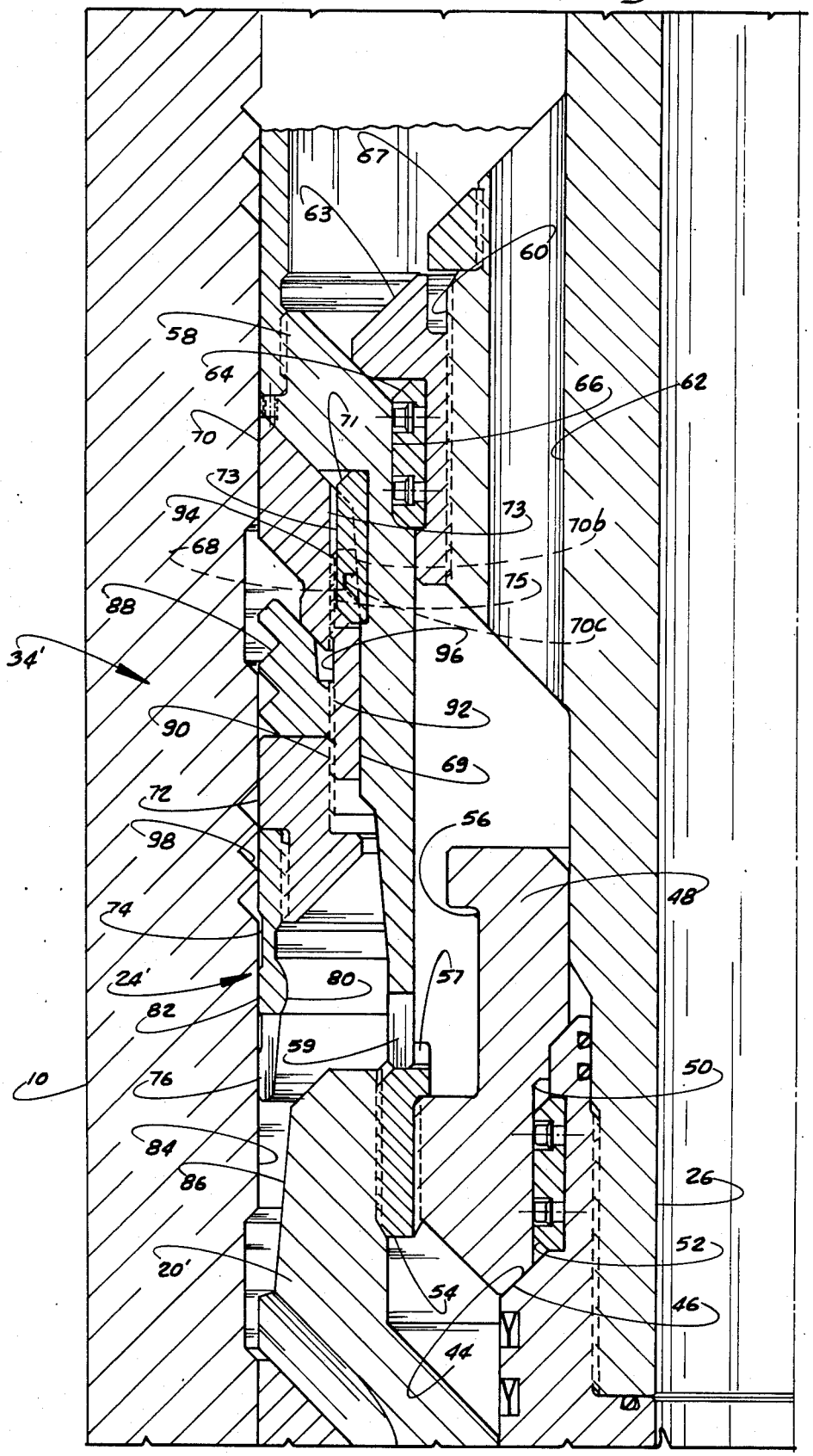
FIG. 4 is an enlarged partial sectional view illustrating the position of the improved structure as the seal assembly is moved toward set position.
Figure 7:
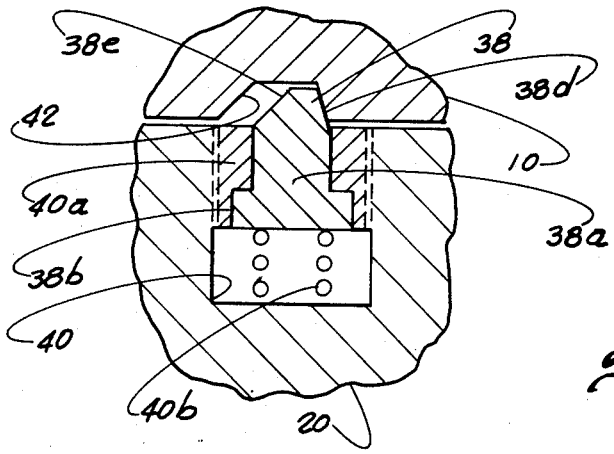
FIG. 7 is a detail sectional view of the preferred structure of the hanger and protector sleeve releasable locking pins.

Casing hanger 20' is shown in FIGS. 2 and 4 landed on shoulder 36 with spring-loaded pins 38 which are positioned in bores 40 on the exterior of hanger 20' and biased outwardly to enter into groove 42 on the interior of casing hanger 20. As best seen in FIG. 7, each of pins 38 include body 38*a* having flange 38b which projects under annular plug 40*a* threaded into bore 40 and spring 40*b*. The portion of body 38*a* which projects outward includes lower tapered surface 38*c* which has a small angle of taper downward and inwardly (for example, 45° ) and upper tapered surface 38*d* which has a high angle of taper upwardly and inwardly (for example, 60° or greater). Thus as hanger 20 is moved downward in housing 10 its lower taper allows it to be cammed into bore 40 by any obstruction it engages. The angle of upper tapered surface 38*d* mates with the taper of the upper portion 42*a* of groove 42. This angle is preselected considering materials and localized conditions so that pins 38 will be cammed into their bores 40 only when an upward pull exceeds their preselected release force. While shear pins may be used in place of pins 38, pins 38 are preferred as they do not result in leaving trash in the well bore when actuated as do shear pins when they have been sheared. Casing hanger 20' is lowered on running tool 26 until it lands on shoulder 36 and pins 38 move into groove 42. Casing hanger 20' is then latched into position and an upward pull on the running string will show the increased weight to indicate the landing and latching of casing hanger 20'. In this position, seal assembly 24' is positioned above the exterior of casing hanger 20' so that cementing may proceed without any obstruction in the return flow.

Figure 5:
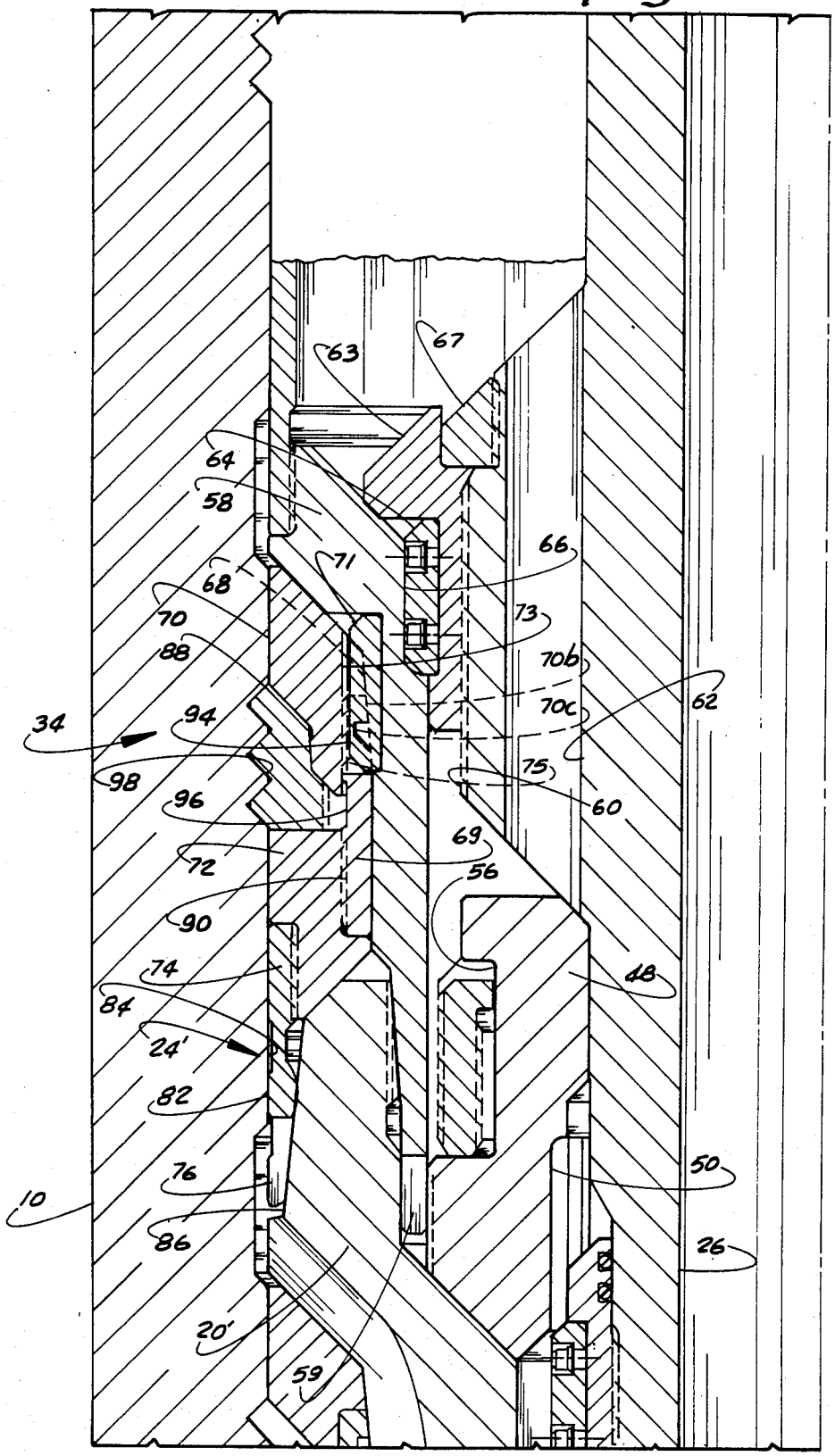
FIG. 5 is another enlarged partial sectional view illustrating the details of the set and latched position of the seal assembly with the running tool in position before removal.

With the completion of cementing, running tool 26 is lowered while being rotated to the right. Running tool 26 includes shoulder 44 which engages lower surface 46 on adapter ring 48 having internal keyway 50 which is engaged by key 52 secured to and extending from the exterior of running tool 26. Split ring 54 is threaded into the interior of the upper end of casing hanger 20' as best shown in FIGS. 4 and 5 and is threaded onto the exterior of adapter ring 48. Immediately above the threaded connection of adapter ring 48 to split ring 54, recess 56 is formed in the exterior of adapter ring 48 which is sufficiently large to receive split ring 54 when it is released from engagement on the exterior threads of adapter ring 48. The upper end of split ring 54 includes slots 57. Protector sleeve 58 has slots 59 in its lower end and interengages with the upper end of split ring 54 so that relative rotation is prevented while they are so engaged. Also, slots 57 and 59 provide a passage for the return flow of fluids during cement and rests on the upper end of split ring 54. Flange 60 on running tool 26 has passages 62 therethrough. Ring 63 is secured to the exterior of flange 60 by right hand threads and has key 64 secured to ring 63 and engaging within Seal keyway 66 on the interior of protector sleeve 58. Lock ring 67 is secured to the upper end of flange 60 and is adapted to engage ring 63 to limit the threading of running tool 26 downwardly through ring 63. Seal assembly 24' and seal latch assembly 34 are supported from protector sleeve 58 by spring loaded pin 68 (which is similar to pin 38) engaging from protector sleeve 58 into release sleeve 69 and cam ring 70 is threaded onto release sleeve 69 with left hand threads. Seal ring 72 is threaded to seal sleeve 74 with right hand threads. Key 71 is positioned in keyway 73 of cam ring 70 and in keyway 75 of release sleeve 69.

Figure 6:
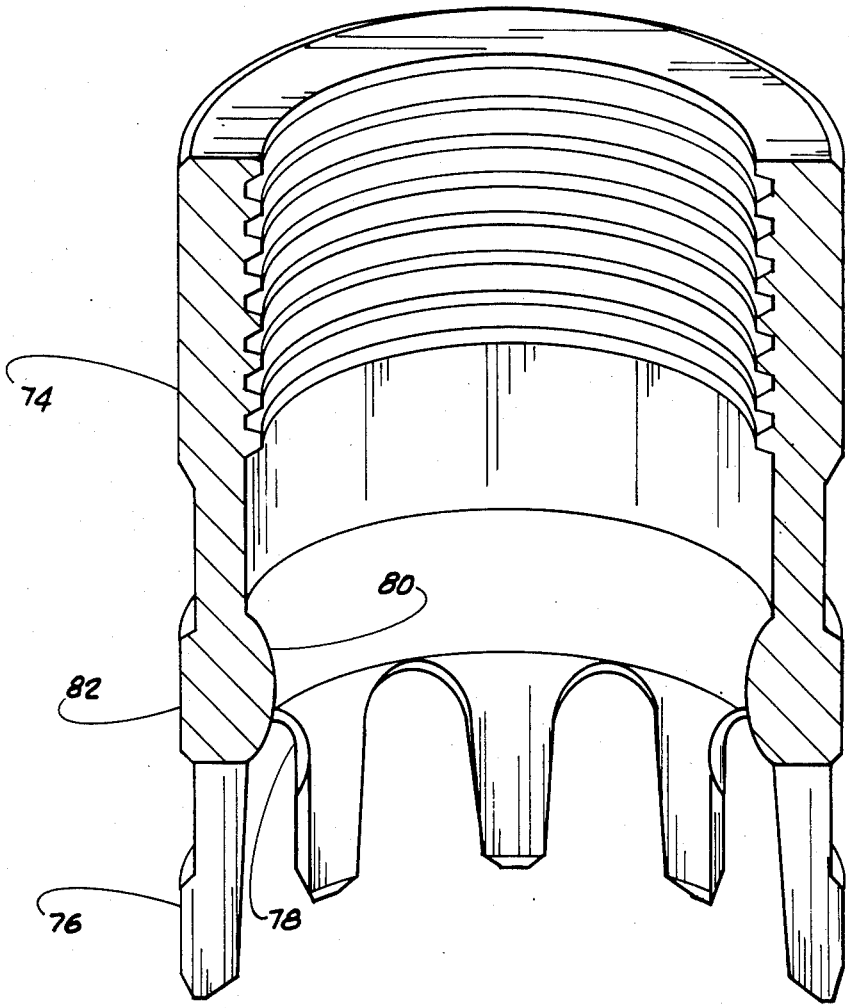
FIG. 6 is an isometric sectional view of the improved seal ring of the present invention.

Seal assembly 24' includes seal ring 72 and seal sleeve 74. Seal sleeve 74 is shown in FIG. 6 includes lower fingers 76 with slots 78 therebetween, rounded internal sealing surface 80 above fingers 76 and external cylindrical sealing surface 82 also above fingers 76. The exterior of sleeve 74 is recessed immediately above and below surface 82 and the diameter of surface 82 is slightly smaller than the external diameter of fingers 76. The upper interior of sleeve 74 is threaded to receive seal ring 72. When set, sealing surface 82 engages interior sealing surface 84 of housing 10 and sealing surface 80 engages tapered exterior surface 86 on the upper end of casing hanger 20'.

Seal latch assembly 34' includes cam ring 70 and split latching ring 88 which is biased inwardly. Release sleeve 69 includes right hand threads 90 which engage seal ring 72 and also engage internal teeth 92 on ring 88. Release sleeve 69 also includes left hand threads 94 which engage cam ring 70 and recess 96 between threads 90 and 94.

The rotation of running tool 26 to the right causes the threading of adapter ring 48 downwardly through split ring 54 and sleeve 60 downwardly in ring 63. When adapter ring 48 has moved completely through split ring 54, split ring 54, which is normally biased inwardly, is free to contract and moves into recess 56. This removes the support for the lower end of protector sleeve 58 to allow sleeve 58 together with seal assembly 24' and seal latch assembly 34 to move downward and rotate independent of split ring 54 and adapter ring 48. By virtue of the connection of key 64 on ring 63 within keyway 66 of protector sleeve 58 the whole structure supported thereon is also rotated. With this rotation seal sleeve 74 is rotated and the exterior of fingers 76 move around the interior sealing surface 84 of housing 10, cleaning any cement or dirt therefrom to ensure a tight seal.

The rotation and downward movement is continued until sealing surface 80 engages on exterior tapered surface 86 of the upper end of casing hanger 20'. Further movement brings sealing surface 82 into engagement with sealing surface 84 on housing 10 and rotation of sleeve 74 is resisted by the friction of the engagement of seal sleeve 74 with surfaces 84 and 86. The threaded connection between release sleeve 69 and seal ring 72 creates additional downward movement to thread release sleeve 69 downward within seal ring 72 and move cam ring 70 downward with respect to latching split ring 88. When the interior threads 92 of ring 88 are in recess 96 ring 88 is then cammed outward by the downward movement of cam ring 70. When the exterior teeth of ring 88 are in registry with grooves 98 on the interior of housing 10, then this movement of cam ring 70 with respect to ring 88 proceeds to move ring 88 outward into engagement with grooves 90. This is after seal sleeve 74 has been moved downward into its position of sealing engagement between the interior surface 84 of housing 10 and the exterior tapered surface 86 of casing hanger 20'. During setting seal assembly 24', seal latch assembly 34' and protector sleeve 58 are all moved downwardly.

With the completion of the setting of both seal assembly 24' and seal latch assembly 34' running tool 26 may be removed from the interior of the wellhead structure 18. On raising of running tool 26, adapter ring 48 with split ring 54 positioned within recess 56 is supported on shoulder 44, and ring 63 is threaded on flange 60 to be removed with running tool 26. The upper end of cam ring 70 includes shoulder **70*a* on which the next casing hanger (not shown) can land and the interior surface 70*b* is tapered downwardly and inwardly to center such casing hanger and includes groove 70*c*** in which the latching pins of the next casing hanger can engage to latch such hanger in its landed position.

When running tool 26 is removed release and retrieval of sealing assembly 24' and latching assembly 34' may be accomplished by first recovering protector sleeve 58 by engagement of its upper portion (not shown) by a suitable retrieving tool. When sufficient tension is exerted on the retrieving tool pins 68 will retract and protector sleeve 58 is retrieved.

Thereafter, a retrieving tool is used which includes a key for engaging within keyway 73 of cam ring 70. Right hand rotation of such retrieving tool caused cam ring to withdraw from under latching split ring 88. Thereafter upward force on seal assembly 24' and latching assembly 34' will cause their release and retrieval. Thus, setting release and retrieval results without left hand rotation of either the running tool or the retrieving tool.

What is claimed is:

1. A subsea wellhead structure comprising a casing hanger having an exterior downwardly facing shoulder, a central bore, an upper internal threaded surface and an upper exterior surface tapered downwardly and outwardly, a seal assembly including a metal seal sleeve having downwardly extending fingers, and an intermediate sealing portion including an internal annular bulbous metal sealing surface and an external cylindrical metal sealing surface, means for latching said sealing assembly in set position, a protector sleeve, and means releasably securing said protector sleeve to said seal assembly and said latching means.

2. A subsea wellhead structure comprising a casing hanger having an exterior downwardly facing shoulder, a central bore, an upper internal threaded surface and an upper exterior surface tapered downwardly and outwardly, a seal assembly including a metal seal sleeve having downwardly extending fingers, and an intermediate sealing portion including an internal annular bulbous metal surface and an external cylindrical metal sealing surface, the fingers of said seal sleeve having a larger outer diameter than the diameter of said external cylindrical metal sealing surface, and means for latching said sealing assembly in set position.

3. A subsea wellhead structure according to claim 2 including a wellhead member having an internal upwardly facing shoulder for receiving said casing hanger exterior shoulder.

4. A subsea wellhead structure according to claim 3 wherein said wellhead member includes an internal surface below said shoulder tapering downwardly and inwardly, and said casing hanger includes a tapered external surface below its shoulder tapering downwardly and inwardly to mate on the said tapered surface on said wellhead member to ensure proper centering of the casing hanger within said wellhead member.

5. A subsea wellhead structure according to claim 2 including hanger latching means carried by said casing hanger biased to latch said casing hanger in landed position once it is landed in proper landed position.

6. A subsea wellhead structure according to claim 1 including a running tool having a shoulder, an adapter ring with external threads, and a recess on its exterior surface above said threads, said adapter ring supported on said shoulder, means for transmitting rotation between said running tool and said adapter ring, and a split ring threaded on said adapter ring and into said upper internal threads of said casing hanger, said split ring being biased inwardly whereby when said adapter ring is threaded downwardly through said split ring, said split ring is released into a position within said recess and out of engagement with said casing hanger.

7. A subsea wellhead structure according to claim 6 wherein said running tool also includes an upper flange with passages extending therethrough, a ring connected to the exterior of said flange by left hand threads, means coacting between said ring connected to said flange and said protector sleeve for the transmission of rotation therebetween.

8. A subsea wellhead structure according to claim 2 wherein said latching means includes an inwardly biased latching split ring having a cm surface, a cam ring having a cam surface mating with the cam surface on said latching ring, and means for moving said cam ring with respect to said latching ring to wedge said latching ring outward into latching engagement with the surface surrounding it.

9. A subsea wellhead structure according to claim 2 wherein said latching means includes an inwardly biased split latching ring, means retaining said latching ring in unlatched position, and means for setting said latching ring.

10. A subsea wellhead structure comprising a casing hanger having an exterior downwardly facing shoulder, a central bore, an upper internal threaded surface and an upper exterior surface tapered downwardly and outwardly, a seal assembly including a metal seal sleeve having downwardly extending fingers, and an intermediate sealing portion including an internal annular bulbous metal sealing surface and an external cylindrical metal sealing surface, means for latching said sealing assembly in set position including an inwardly biased split latching ring in unlatched position, a release sleeve, means threadedly connecting said release sleeve to said seal sleeve, and a cam ring connected to said release sleeve and coacting with said latching ring, said release sleeve retaining said latching ring in unlatched position, rotation of said release sleeve moving said cam ring under said latching ring to move said latching ring into latching position.

11. A subsea wellhead structure according to claim 10 wherein said retaining means includes threads the interior of said latching ring said latching ring threads in unset position engaging the exterior threads on said release sleeve.

12. A subsea wellhead structure according to claim 11 wherein said threads on the interior of said cam ring engaging said release sleeve are left hand threads, and means on said cam ring for engagement and rotation, right hand rotation of said cam ring unsetting said latching means.

13. A subsea wellhead structure according to claim 1 wherein said releasable securing means includes a pin positioned within a bore in the exterior of said hanger, means biasing said pin outwardly of said hanger, said pin having a moderately tapered lower surface to cam said pin into its bore, said pin having a tapered surface with a high degree of taper which degree of taper is preselected to determine the force to cam said pin into its bore for release from latched position.

14. A subsea wellhead structure according to claim 2 wherein said latching means includes a latching element having a cam surface, a cam ring having a cam surface mating with the cam surface on said latching element, and means for moving said cam ring with respect to said latching element to wedge said element outward into latching engagement with the surrounding surface.

15. A subsea wellhead structure according to claim 2 wherein said latching means includes a latching element means retaining said latching element in unlatched position, and means for setting said latching element.

16. A subsea wellhead structure comprising a casing hanger having an exterior downwardly facing shoulder, a central bore, an upper internal threaded surface and an upper exterior surface tapered downwardly and outwardly, a seal assembly including a metal seal sleeve having downwardly extending fingers, and an intermediate sealing portion including an internal annular bulbous metal sealing surface and an external cylindrical metal sealing surface, means for latching said sealing assembly in set position including a latching element, a release sleeve, means threadedly connecting said release sleeve to said seal sleeve, and a cam ring connected to said release sleeve and coacting with said latching element, said release sleeve retaining said latching element in unlatched position, rotation of said release sleeve moving said cam ring inside said element to move said element into latching position

17. A subsea wellhead structure according to claim 16 wherein said retaining means includes threads on the interior of said element said element threads in unset position engaging the exterior threads on said release sleeve.

* * * * *